US009464477B2

(12) United States Patent
Liao

(10) Patent No.: US 9,464,477 B2
(45) Date of Patent: Oct. 11, 2016

(54) SAFETY WINDOW GRID ASSEMBLY

(71) Applicant: ACCVAL L.L.C., Dover, DE (US)

(72) Inventor: Chen-Jui Liao, Dover, DE (US)

(73) Assignee: ACCVAL L.L.C., Dover, DE (US)

( * ) Notice: Subject to any disclaimer, the term of this patent is extended or adjusted under 35 U.S.C. 154(b) by 0 days.

(21) Appl. No.: 14/497,762

(22) Filed: Sep. 26, 2014

(65) Prior Publication Data

US 2015/0089874 A1 Apr. 2, 2015

(30) Foreign Application Priority Data

Sep. 30, 2013 (TW) ..... 102135342 A

(51) Int. Cl.
*E06B 9/06* (2006.01)

(52) U.S. Cl.
CPC ..... *E06B 9/06* (2013.01); *E06B 9/0646* (2013.01); *E06B 2009/0684* (2013.01)

(58) Field of Classification Search
CPC ..... E06B 9/06; E06B 9/0646; E06B 2009/0684; E06B 2009/002; E06B 9/01
See application file for complete search history.

(56) References Cited

U.S. PATENT DOCUMENTS 5,559,409 A * 9/1996 Beierwaltes ..... E05F 15/627 318/282
6,064,036 A * 5/2000 Kensrue ..... B23K 9/1333 219/137.2
6,112,800 A * 9/2000 Marusak ..... E06B 9/322 160/298
2003/0111189 A1* 6/2003 Palmer ..... E06B 9/322 160/170
2003/0111191 A1* 6/2003 Ciuca ..... E06B 9/322 160/170
2003/0213661 A1* 11/2003 VerSteeg ..... E05D 13/003 188/271
2004/0006904 A1* 1/2004 Hildenbrand ..... G09F 7/18 40/606.01
2005/0173078 A1* 8/2005 Perez ..... A01K 1/035 160/99
2009/0008042 A1* 1/2009 Snyder ..... E01F 13/028 160/264
2010/0206492 A1* 8/2010 Shevick ..... E06B 9/30 160/170

* cited by examiner

*Primary Examiner* — Gregory Strimbu
(74) *Attorney, Agent, or Firm* — Hamre, Schumann, Mueller & Larson, P.C.

(57) ABSTRACT

A safety window grid assembly includes a hollow housing, a rotating shaft rotatably disposed in the housing, a cord and a locking mechanism. The cord is retractable and extendable relative to the rotating shaft between a retracted state and an extended state. The locking mechanism is disposed on the housing, and includes an operating member rotatable relative to the housing, a driving member connected co-rotatably to the operating member, and a locking member. The locking member is movable between a locking position where a portion of the cord is clamped between the rotating shaft and the locking member such that the cord is not movable, and an unlocking position where the locking member is spaced apart from the cord such that the cord is movable.

10 Claims, 12 Drawing Sheets

SAFETY WINDOW GRID ASSEMBLY

CROSS-REFERENCE TO RELATED APPLICATION

This application claims priority of Taiwanese Patent Application No. 102135342, filed on Sep. 30, 2013, the entire disclosure of which is hereby incorporated by reference.

FIELD OF THE INVENTION

This invention relates to a safety window grid assembly.

BACKGROUND OF THE INVENTION

In order to prevent people from falling down through an open window, there is provided a conventional safety window grid assembly for protecting people's life. However, the conventional safety window grid assembly is not convenient to use. Therefore, there is still room for improvement.

SUMMARY OF THE INVENTION

Therefore, the object of the present invention is to provide a safety window grid assembly that can overcome the aforesaid drawback of the prior art.

According to this invention, a safety window grid assembly includes a housing, a rotating shaft, a cord and a locking mechanism. The housing is hollow and extends in a longitudinal direction. The rotating shaft is rotatably disposed in the housing and has an axis perpendicular to the longitudinal direction. The cord has a first end portion secured to the rotating shaft and a second end portion, is wound on the rotating shaft, and is retractable and extendable relative to the rotating shaft between a retracted state and an extended state. The cord is distributed in series along the axis of the rotating shaft when the cord is in the retracted state, and is partly unwound from the rotating shaft to form a grid structure when the cord is in the extended state. Conversion of the cord between the retracted state and the extended state results in rotation of the rotating shaft in the housing. The locking mechanism is disposed on the housing, and includes an operating member, a driving member and a locking member. The operating member is exposed from the housing and is rotatable relative to the housing. The driving member is disposed in the housing and is connected co-rotatably to the operating member. The locking member is connected to the driving member such that the locking member is movable in the longitudinal direction between an unlocking position and a locking position relative to the rotating shaft in response to rotation of the driving member. When the locking member is in the locking position relative to the rotating shaft, a portion of the cord is clamped between the rotating shaft and the locking member such that the cord is not movable relative to the rotating shaft. When the locking member is in the unlocking position relative to the rotating shaft, the locking member is spaced apart from the cord such that the cord is movable relative to the rotating shaft.

BRIEF DESCRIPTION OF THE DRAWINGS

Other features and advantages of the present invention will become apparent in the following detailed description of the embodiments of this invention, with reference to the accompanying drawings, in which.

DETAILED DESCRIPTION OF THE EMBODIMENTS

Figure 1:
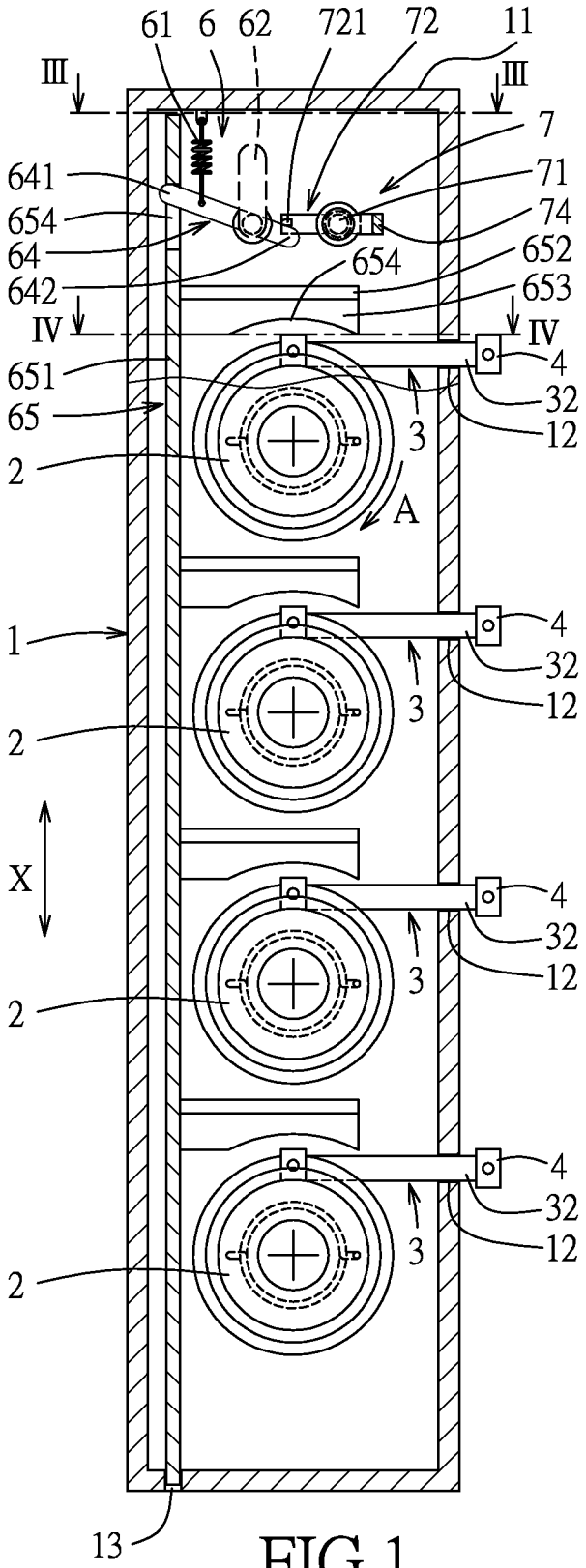
FIG. 1 is a sectional view of the first embodiment of a safety window grid assembly according to this invention, showing a retracted state of cords.
Figure 2:
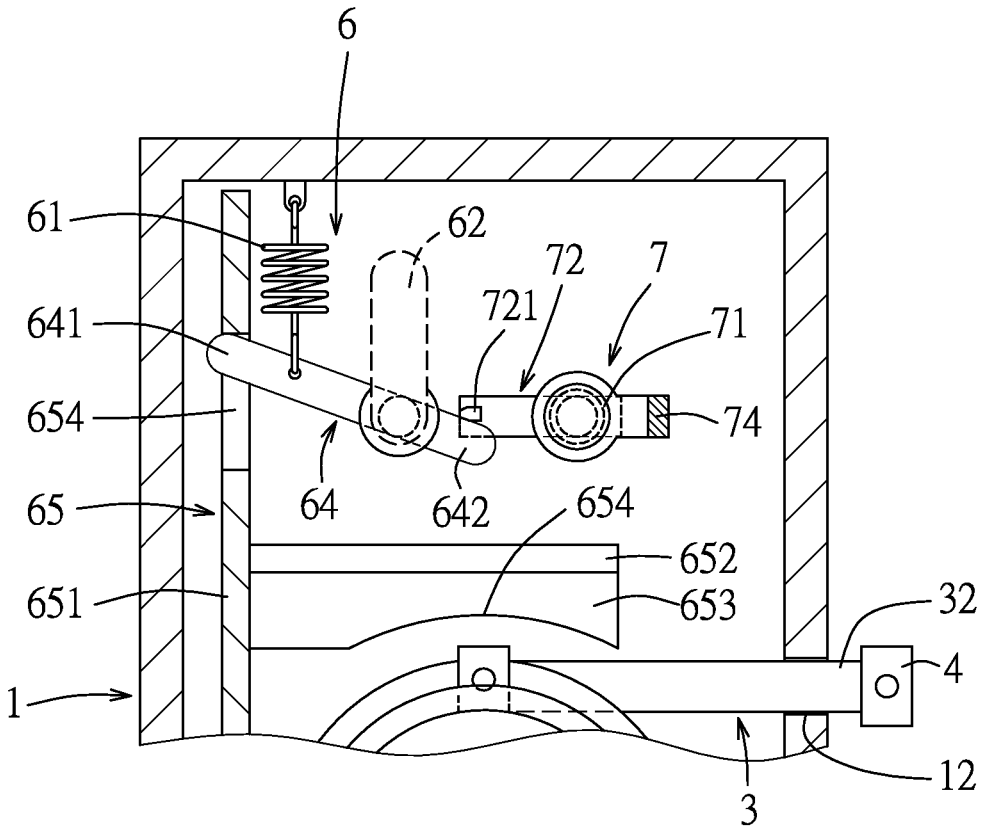
FIG. 2 is a fragmentary enlarged view of FIG. 1, showing an unlocking position of a locking member.
Figure 3:
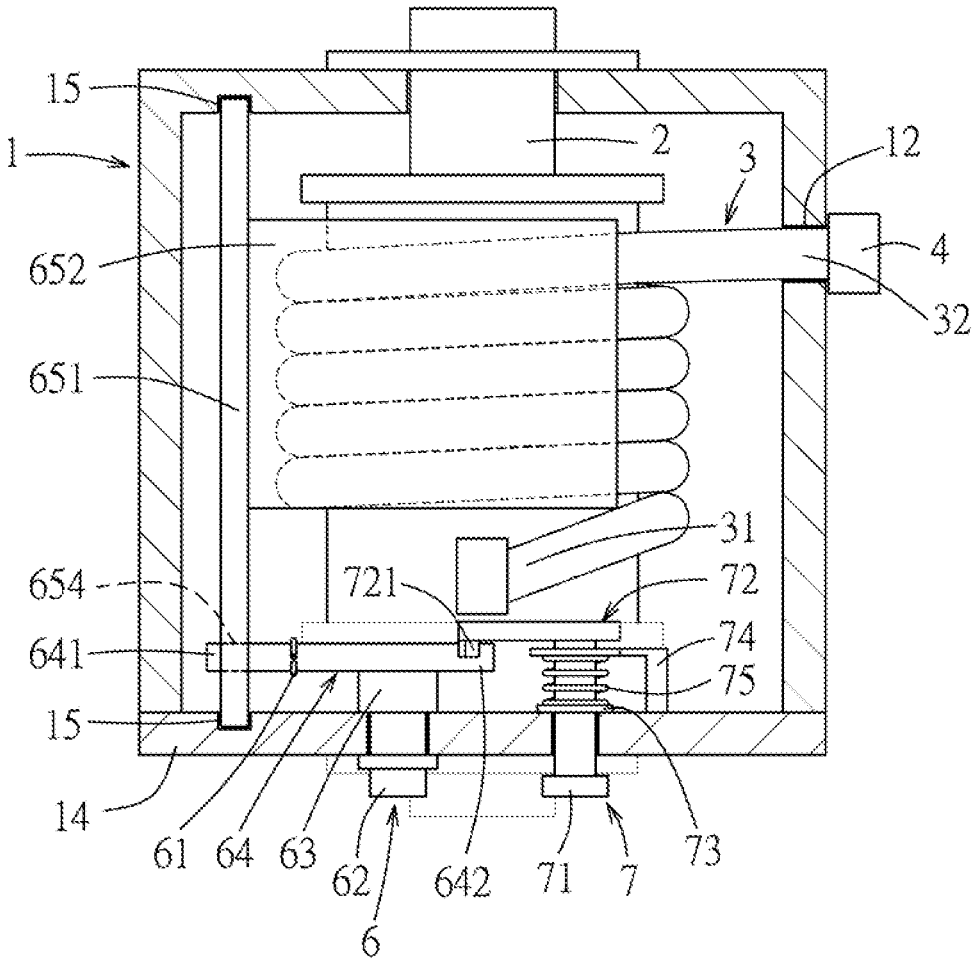
FIG. 3 is a sectional view of the first embodiment taken along line III-III in FIG. 1.
Figure 4:
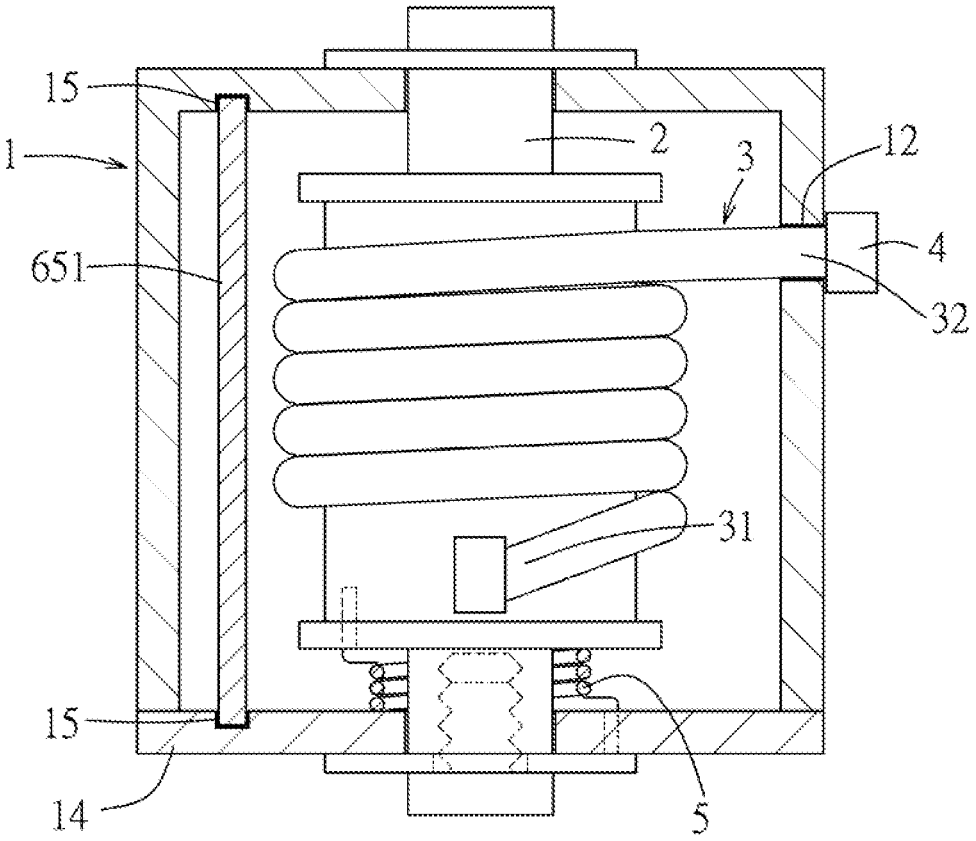
FIG. 4 is a sectional view of the first embodiment taken along line IV-IV in FIG. 1.

Before the present invention is described in greater detail, it should be noted that like elements are denoted by the same reference numerals throughout the disclosure.

Referring to FIGS. 1 to 4, the first embodiment of a safety window grid assembly according to the present invention is shown to include a housing 1, four rotating shafts 2, four cords 3, four torsion springs 5, four connecting units 4, a locking mechanism 6 and a positioning mechanism 7.

The housing 1 is hollow and extends in a longitudinal direction (X). The housing 1 includes a base wall 11 that is disposed at a side thereof and a side wall 1A that extends in the longitudinal direction (X). The housing 1 is formed with four through holes 12, an opening 13 that is disposed at an opposite side thereof and that is spaced apart from the base wall 11 in the longitudinal direction (X), and two slide slots 15 that extend in the longitudinal direction (X) and that are spaced apart with each other.

The rotating shafts 2 are parallel to and spaced apart with one another in the longitudinal direction (X), and extend in a direction perpendicular to the longitudinal direction (X). Since the rotating shafts 2 are identical in structure, for the sake of brevity, only one rotating shaft 2 will be described in the following description. The rotating shaft 2 is rotatably disposed in the housing 1 and has an axis perpendicular to the longitudinal direction (X). An end of the rotating shaft 2 is disposed on the side wall 14 of the housing 1.

Figure 5:
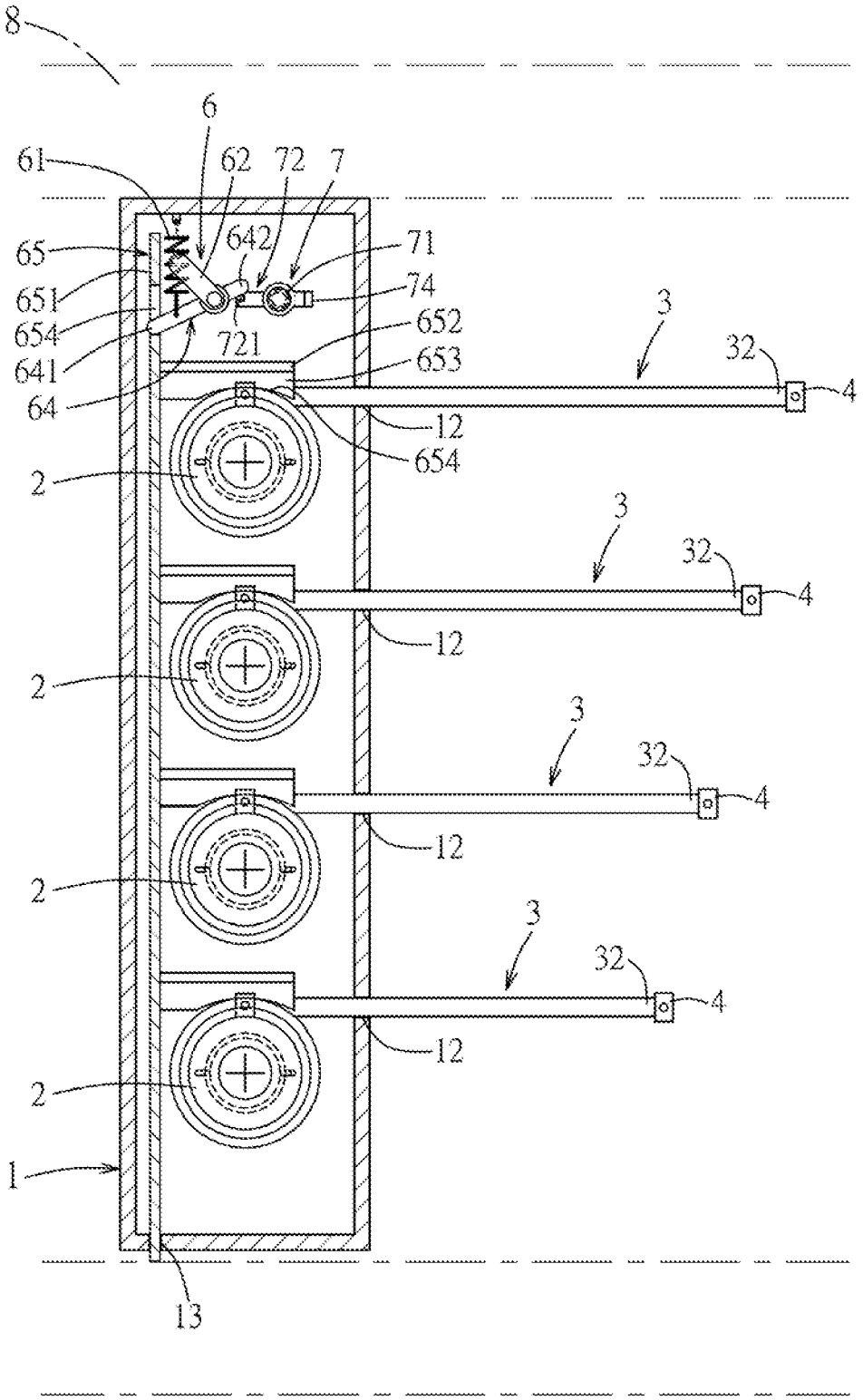
FIG. 5 is a sectional view of the first embodiment, showing an extended state of the cords.

The cords 3 are respectively wound on the rotating shafts 2. Since the cords 3 are identical in structure, for the sake of brevity, only one cord 3 will be described in the following description. The cord 3 has a first end portion 31 that is secured to the rotating shaft 2 and a second end portion 32. The through holes 12 of the housing 1 are respectively configured to permit the second end portions 32 of the cords 3 to extend therethrough. The cord 3 is retractable and extendable relative to the rotating shaft 2 to between a retracted state and an extended state. When the cord 3 is in the retracted state, the cord 3 is helical in shape and is distributed in series along the axis of the rotating shaft 2 (see FIGS. 1 and 3). When the cord 3 is in the extended state, the cord 3 is partly unwound from the rotating shaft 2 to form a grid structure (see FIG. 5). Conversion of the cord 3 between the retracted state and the extended state results in rotation of the rotating shaft 2 in the housing 1.

The torsion springs 5 are respectively mounted on the rotating shafts 2. Since the torsion springs 5 are identical in structure, for the sake of brevity, only one torsion spring 5 will be described in the following description. The torsion springs 5 is mounted for providing a restoring force of the rotating shaft 2 so as to allow the cord 3 to be positioned from the extended state into the retracted state. To be more specific, when the cord 3 is pulled by an external force, the cord 3 is partly unwounded and pulled out from the housing 1 (i.e., positioned in the extended state) such that the rotating shaft 2 rotates in a clockwise direction (A) (see FIG. 1). When the external force is released, the restoring force provided by the torsion spring 5 drives the rotating shaft 2 to rotate in a counterclockwise direction such that the cord 3 returns to the retracted state.

Figure 7:
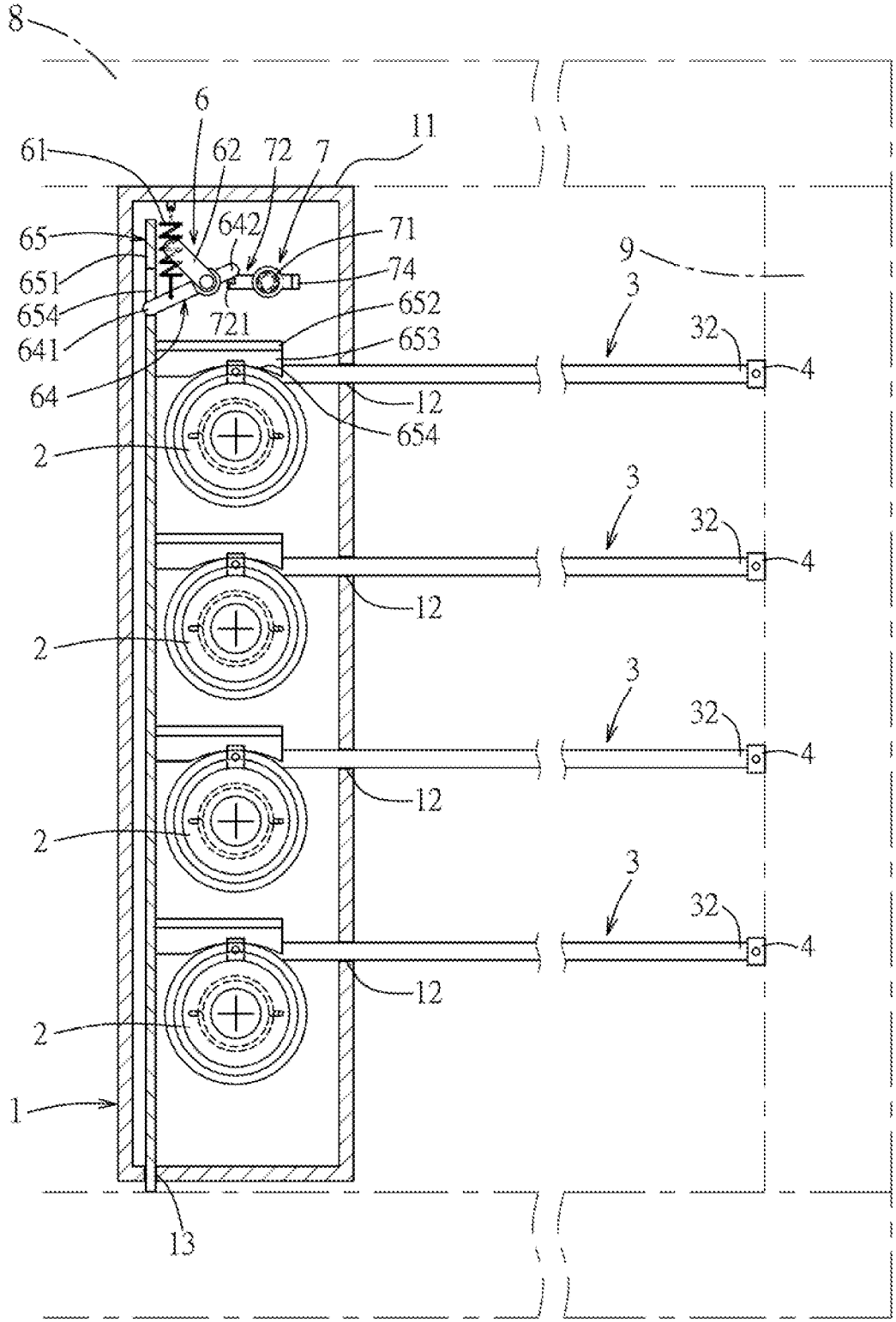
FIG. 7 is a sectional view of the first embodiment, showing the safety window grid assembly connected to a fixed article.

The connecting units 4 are respectively mounted on the second end portions 32 of the cords 3. Since the connecting units 4 are identical in structure, for the sake of brevity, only one connecting unit 4 will be described in the following description. The connecting unit 4 is exposed from the housing 1 and is configured to be correctable removably with a fixed article 9 (see FIG. 7).

Figure 6:
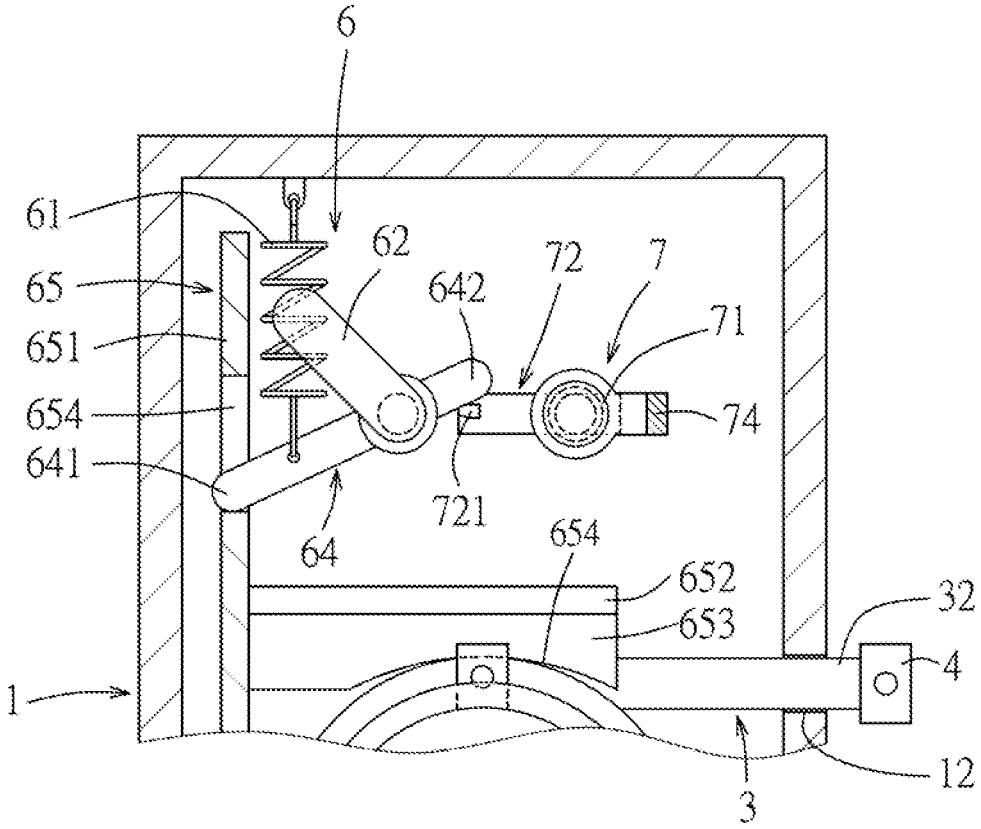
FIG. 6 is a fragmentary enlarged sectional view, showing a locking position of a locking member.

The locking mechanism 6 is disposed on the housing 1, and includes an operating member 62, a driving member 64, a locking member 65, a connecting member 63 and an tension spring 61. The operating member 62 is exposed from the housing 1, is rotatable relative to the housing 1, and is configured as a solid rod. The driving member 64 is disposed in the housing 1, is connected co-rotatably to the operating member 62, and is configured as a rod. The connecting member 63 is configured as a rod, extends rotatably through the side wall 14 of the housing 1, and has opposite ends that are respectively and fixedly connected to the operating member 62 and the driving member 64 such that the driving member 64 is co-rotatable relative to the operating member 62. The locking member 65 is connected to the driving member 64 such that the locking member 65 is movable in the longitudinal direction (X) between an unlocking position (see FIG. 2) and a locking position (see FIG. 6) relative to the rotating shaft 2 in response to rotation of the driving member 64. The tension spring 61 has opposite ends that are respectively connected to the base wall 11 of the housing 1 and the driving member 64, and generates a restoring force to return the driving member 64 to its original position so as to move the locking member 65 to the unlocking position.

To be specific, the driving member 64 has a first end portion 641 connected to the locking member 65 for driving movement of the locking member 65, and a second end portion 642 opposite to the first end portion 641. The locking member 65 includes a plate body 651, four extending walls 652 and four braking pads 653.

The plate body 651 extends in the longitudinal direction (X), is spaced apart from the rotating shaft 2, and is formed, with an aperture 654 that extends in the longitudinal direction (X) and that is configured to receive the first end portion 641 of the driving member 64. The slide slots 15 of the housing 1 are configured to respectively and movably receive two opposite sides of the plate body 651 therein.

The extending walls 652 extend from the plate body 651 in a direction perpendicular to the longitudinal direction (X). Each of the extending walls 652 is disposed between a respective one of the rotating shafts 2 and the base wall 11. In other words, the rotating shafts 2 and the extending walls 652 are alternately arranged along the longitudinal direction (X). In this embodiment, the extending walls 652 are made of a stainless steel material.

The braking pads 653 are respectively secured to the extending walls 652. Each of the braking pads 653 is disposed between a corresponding one of the extending walls 652 and a corresponding one of the rotating shafts 2, and has an arc surface 654 that faces the corresponding one of the rotating shafts 2 and that is complementary in shape to the corresponding one of the rotating shafts 2. In this embodiment, the braking pads 653 are made of a rubber material.

When the locking member 65 is in the locking position (see FIGS. 5 and 7) relative to the rotating shaft 2, an end portion of the plate body 651 of the locking member 65 extends through the opening 13 of the housing 1 so that the end portion of the plate body 651 of the locking member 65 and the base wall 11 abut against a window frame 3 (see FIGS. 5 and 7) for fixing the housing 1 in the window frame 8, and a portion of the cord 3 is clamped between the braking pad 653 of the locking member 65 and the rotating shaft 2 such that the cord 3 is not movable.

When the locking member 65 is in the unlocking position (see FIG. 1) relative to the rotating shaft 2, the plate body 651 is disposed in the housing 1, and the braking pad 653 of the locking member 65 is spaced apart from, the cord 3 such that the cord 3 is movable.

The positioning mechanism 7 is disposed on the housing 1, and includes a positioning member 71, an abutting member 72, a fixed wall 74, a stop member 73 and a compression spring 75. The positioning member 71 is partly exposed from the housing 1 and is movable relative to the housing 1 between an abutting position and a free position. The fixed wall 74 is connected fixedly to the side wall 14 of the housing 1. The abutting member 72 is disposed in the housing 1, is connected fixedly to the positioning member 71, and is adjacent to the fixed wall 74. The stop member 73 is sleeved fixedly on the positioning member 71. The compression spring 75 is disposed between the fixed wall 74 and the stop member 73 and is sleeved on the positioning member 71. The positioning member 71 extends through the fixed wall 74 such that, when the positioning member 71 is in the free position relative to the housing 1 and is released, the compression spring 75 generates a restoring force to move the positioning member 71 back to the abutting position.

Figure 8:
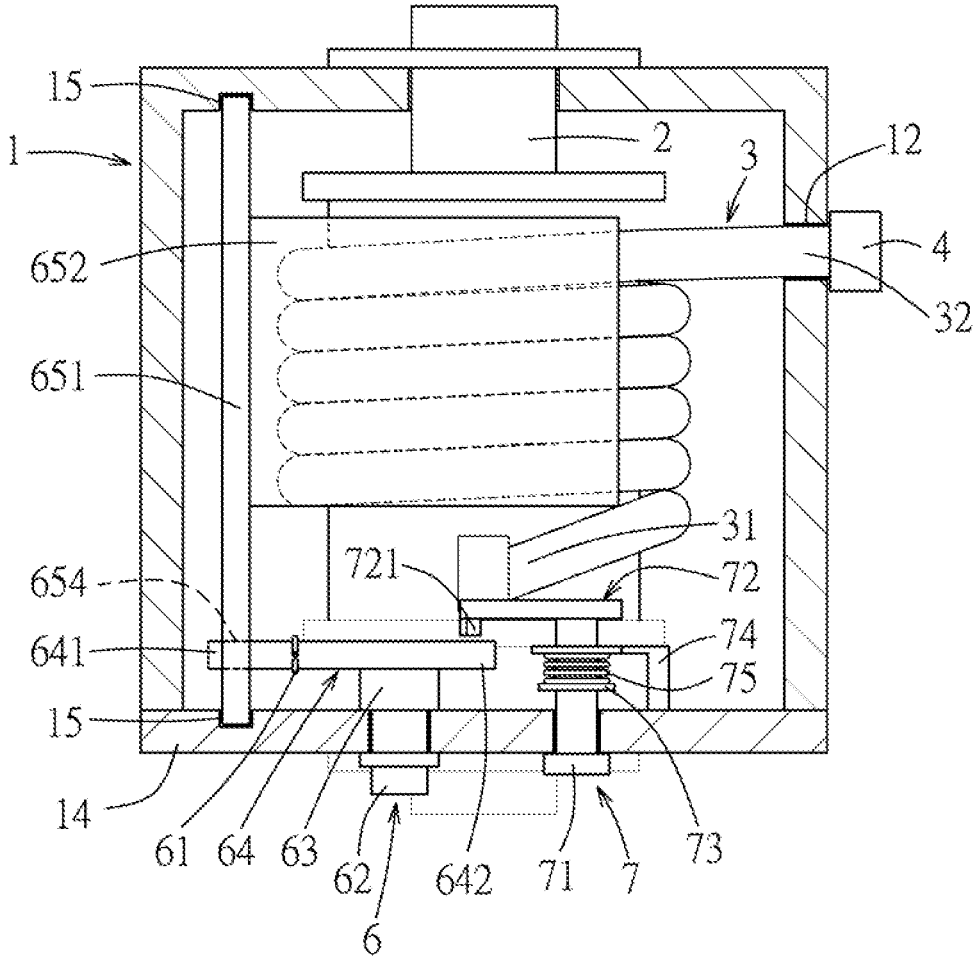
FIG. 8 is a sectional view of the first embodiment, showing a free position of a positioning member.
Figure 9:
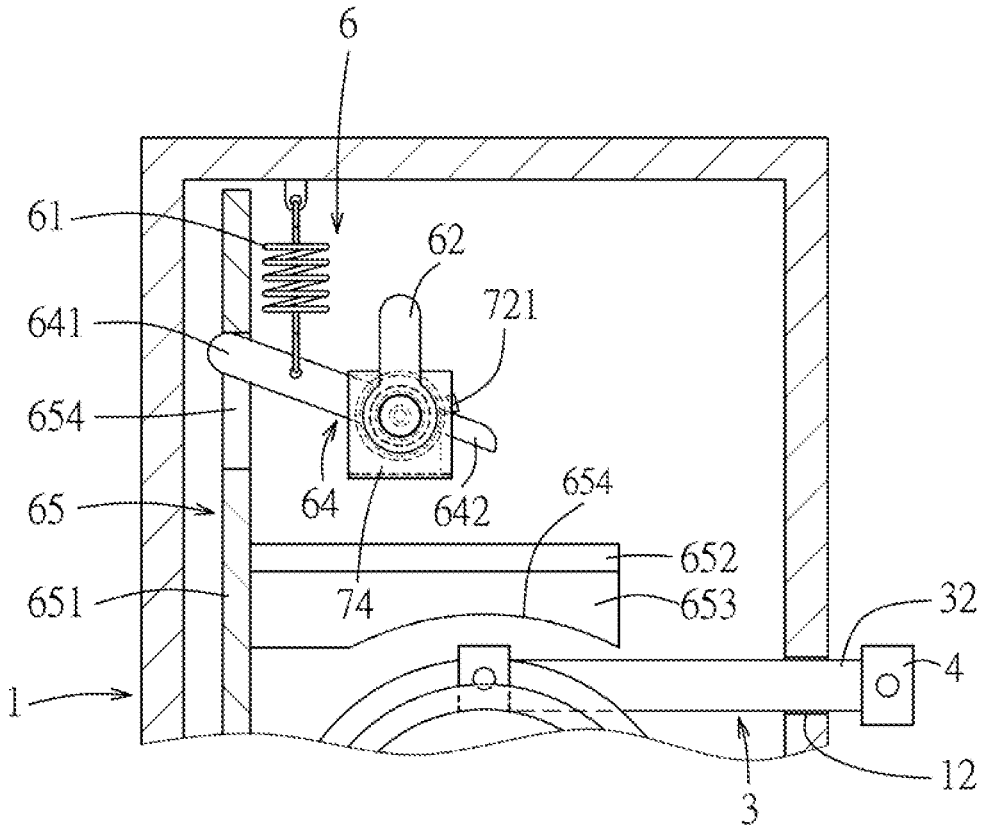
FIG. 9 is a sectional view of the second embodiment of a safety window grid assembly according to this invention, showing an unlocking position of a locking member.
Figure 10:
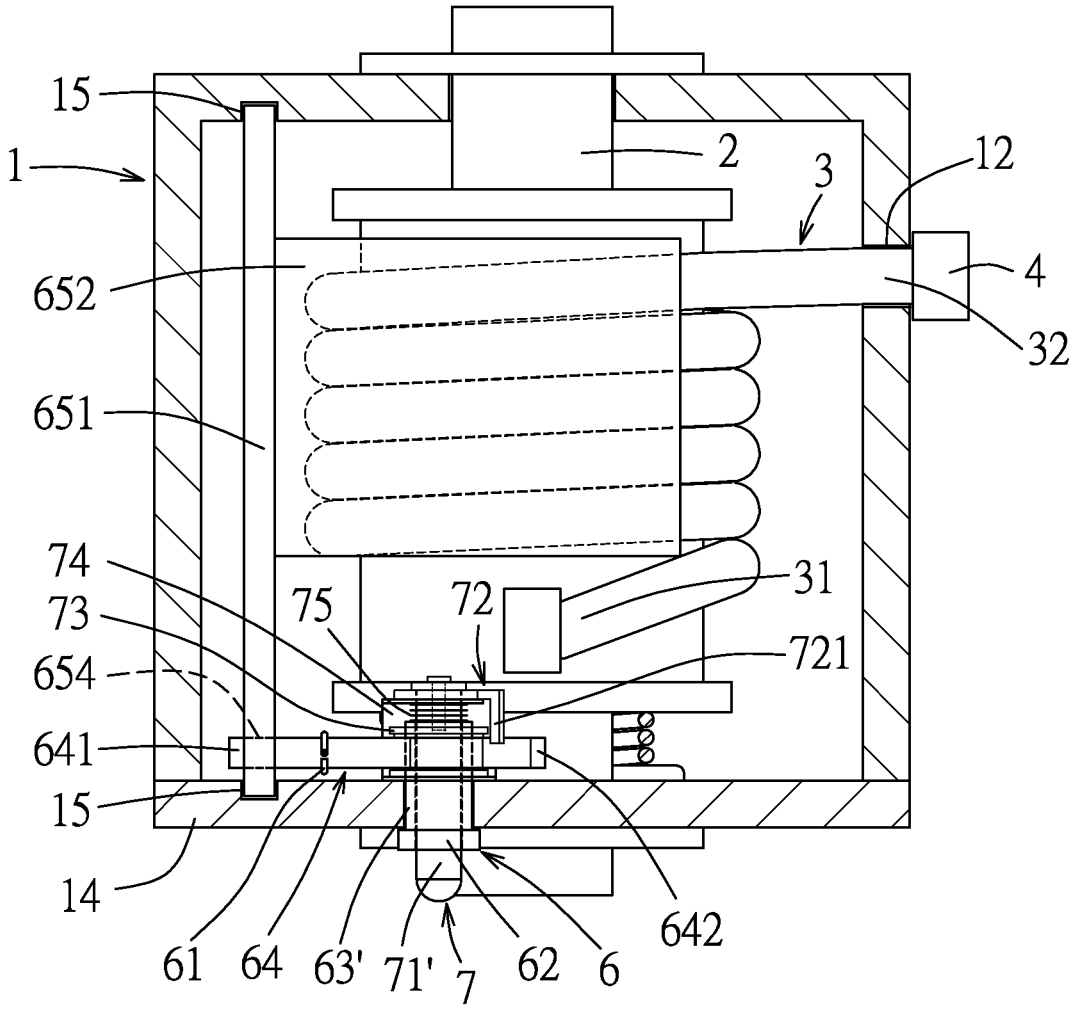
FIG. 10 is a sectional view of the second embodiment, showing an abutting position of a positioning member.
Figure 11:
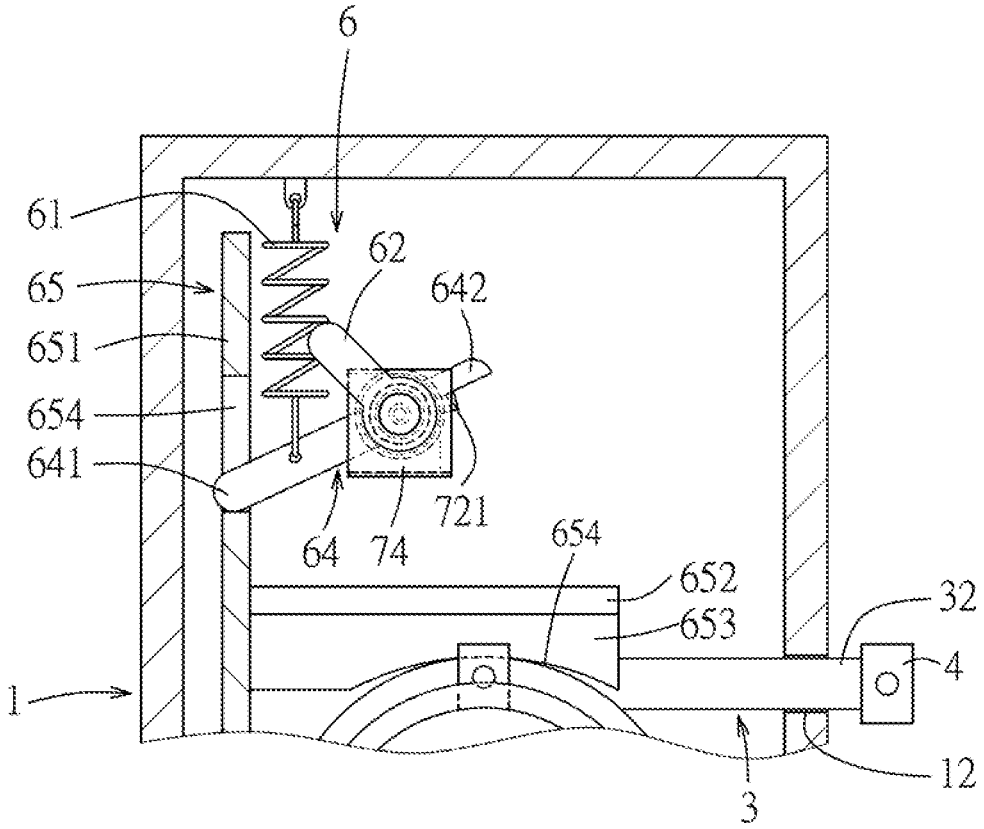
FIG. 11 is a sectional view of the second embodiment, showing a locking position of the locking member.
Figure 12:
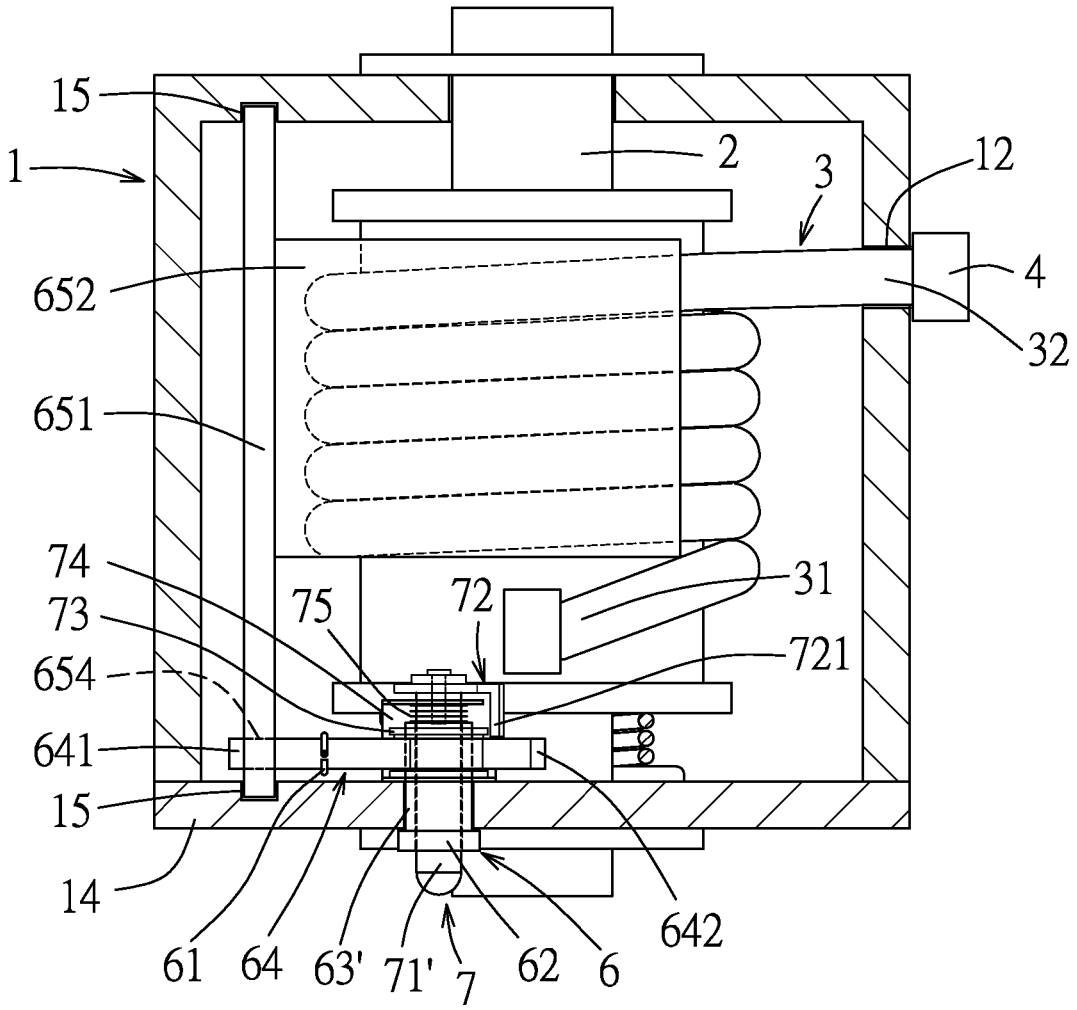
FIG. 12 is a sectional view of the second embodiment, showing a free position of the positioning member.

To be more specific, when the positioning member 71 is in the abutting position (see FIG. 3) relative to the housing 1, the abutting member 72 abuts against the second end portion 642 of the driving member 64 such that the second end portion 642 of the driving member 64 is not rotatable toward the abutting member 72. When the positioning member 71 is in the free position (see FIG. 8) relative to the housing 1, the abutting member 72 is spaced apart from the second end portion 642 of the driving member 64 such that the second end portion 642 of the driving member 64 is rotatable from one side of the abutting member 72 to the other side of the abutting member 72. In this embodiment, the abutting member 72 has a protrusion 721 for abutting against the driving member 64 of the looking mechanism 6.

To be more specific, when the positioning member 71 is pushed by an external force, the abutting member 72 is moved from the abutting position to the free position and is spaced apart from the second end portion 642 of the driving member 64 such that the second end portion 642 of the driving member 64 is rotatable from one side of the abutting member 72 to the other side of the abutting member 72. When the external force is released, the restoring force provided by the compression spring 75 drives the positioning member 71 to move from the free position back to the abutting position such that the driving member 64 is not rotatable toward the abutting member 72. It should be noted that when the locking member 65 is in the locking position, the abutting member 72 abuts against a bottom side of the driving member 64 (see FIG. 6) for maintaining said locking member 65 at the locking position; when the locking member 65 is in the unlocking position, thee abutting member 72 abuts against an upper side of the driving member 64 (see FIG. 2) for maintaining the locking member 65 at the unlocking position.

It should be noted that, in this disclosure, each of the cords 3 along with the corresponding one of the rotating shaft 2 is independent such that each of the cords 3 can provide a grid structure with different length. Therefore, the safety window grid assembly is suitable for a variety of window frames 8.

Referring to FIGS. 9 to 12, the second embodiment of a safety window grid assembly according to the present invention is similar to that of the first embodiment, except that the connecting member 63' is tubular, and the positioning member 71' extends movably into the connecting member 63'. To be more specific, the locking member 65 is movable in the longitudinal direction (X) between an unlocking position (see FIG. 9) and a locking position (see FIG. 11) relative to the rotating shaft 2 in response to rotation of the driving member 64. The positioning member 71' is movable relative to the housing 1 between an abutting position (see FIG. 10) and a free position (see FIG. 12).

To sum up, the safety window grid assembly according to the present invention is convenient and easy for users to use. Therefore, the object of the present invention can be accomplished.

While the present invention has been described in connection with what are considered the most practical embodiments, it is understood that this invention is not limited to the disclosed embodiments but is intended to cover various arrangements included within the spirit and scope of the broadest interpretation and equivalent arrangements.

What is claimed is:

1. A safety window grid assembly, comprising:

a hollow housing having a longitudinal direction;

a rotating shaft rotatably disposed in said housing and having an rotational axis extending perpendicularly to the longitudinal direction;

a cord that has a first end secured to said rotating shaft, the cord being retractable and extendable relative to said rotating shaft between an extended state and a retracted state, said cord being wound on said rotating shaft with revolutions of said cord extending along the axis of said rotating shaft when said cord is in the retracted state, said cord being partly unwound from said rotating shaft when said cord is in the extended state, movement of said cord between the retracted state and the extended state causes rotation of said rotating shaft in said housing;

a locking mechanism disposed on said housing, and including an operating member that is disposed outside of said housing and that is rotatable relative to said housing, a driving member that is disposed in said housing and that is connected co-rotatably to said operating member, and a locking member that is connected to said driving member such that said locking member is movable in the longitudinal direction between an unlocking position and a locking position relative to said rotating shaft in response to rotation of said driving member; and wherein when said locking member is in the locking position relative to said rotating shaft, a portion of said cord is clamped between said rotating shaft and said locking member such that said cord is not movable relative to said rotating shaft, and when said locking member is in the unlocking position relative to said rotating shaft, said locking member is spaced apart from said cord such that said cord is movable relative to said rotating shaft.

2. The safety window grid assembly as claimed in claim 1, wherein said housing includes an opening such that, when said locking member is in the locking position, an end portion of said locking member extends through said opening, so that said end portion of said locking member is adapted to abut against a window frame.

3. The safety window grid assembly as claimed in claim 2, wherein:

said driving member of said locking mechanism has a first end portion connected to said locking member for moving said locking member, and a second end portion opposite to said first end portion of said driving member;

said safety window grid assembly further comprises a positioning mechanism disposed on said housing;

said positioning mechanism includes a positioning member partly extending out of said housing and being movable relative to said housing between an abutting position and a free position, and includes an abutting member disposed in said housing and connected to said positioning member;

wherein when said positioning member is in the abutting position relative to said housing, said abutting member of said positioning mechanism abuts against said second end portion of said driving member such that said second end portion of said driving member is not rotatable in a first direction toward said abutting member of said positioning mechanism; and wherein when said positioning member is in the free position relative to said housing, said abutting member of said positioning mechanism is spaced apart from said second end portion of said driving member such that said second end portion of said driving member is rotatable in said first direction and a second direction opposite said first direction.

4. The safety window grid assembly as claimed in claim 3, wherein:

said housing further includes a side wall extending in the longitudinal direction; and said locking mechanism further includes a connecting member extending rotatably through said side wall of said housing and having opposite ends that are respectively and fixedly connected to said operating member and said driving member, and a tension spring having opposite ends that are respectively connected to said housing and said driving member, said tension spring exerting a restoring force on said driving member so as to urge said locking member toward the unlocking position.

5. The safety window grid assembly as claimed in claim 4, wherein said connecting member is tubular, and said positioning member extends movably into said connecting member.

6. The safety window grid assembly as claimed in claim 4, wherein:

said locking member of said locking mechanism includes a plate body extending in the longitudinal direction, spaced apart from said rotating shaft, and being formed with an aperture that extends in the longitudinal direction said aperture of said plate body is configured to receive said first end portion of said driving member of said locking mechanism, an extending wall extending from said plate body in a direction perpendicular to the longitudinal direction, and a braking pad secured to said extending wall, disposed between said extending wall and said rotating shaft, and having an arc surface that faces said rotating shaft;

when said locking member is in the locking position relative to said rotating shaft, said end portion of said locking member extends through said opening of said housing, and said portion of said cord is clamped between said braking pad of said locking member and said rotating shaft such that said cord is not movable relative to said rotating shaft; and when said locking member is in the unlocking position relative to said rotating shaft, and said braking pad of said locking member is spaced apart from said cord such that said cord is movable relative to said rotating shaft.

7. The safety window grid assembly as claimed in claim 6, wherein said housing is further formed with two slide slots that are configured to respectively and movably receive two opposite sides of said plate body therein.

8. The safety window grid assembly as claimed in claim 3, wherein:

said positioning mechanism further includes a fixed wall connected to said housing, a stop member fixed on said positioning member, and a compression spring disposed between said fixed wall and said stop member;

said abutting member is adjacent to said fixed wall; and said positioning member extends through said fixed wall such that, when said positioning member is in the free position relative to said housing and is released, said compression spring generates a restoring force to urge said positioning member toward the abutting position.

9. The safety window grid assembly as claimed in claim 1, further comprising a connecting unit that is mounted on a second end portion of said cord, said housing including a through hole that is configured to permit the second end portion of said cord to extend therethrough, said connecting unit being configured to be removably connectable with a fixed article.

10. The safety window grid assembly as claimed in claim 1, further comprising a torsion spring mounted on said rotating shaft for providing a restoring force to said rotating shaft which urges said cord to move from the extended state toward the retracted state.

* * * * *